US005280505A

United States Patent [19]

Hughey et al.

[11] Patent Number: 5,280,505

[45] Date of Patent: Jan. 18, 1994

[54] METHOD AND APPARATUS FOR GENERATING ISOTOPES

[75] Inventors: Barbara Hughey, Arlington; Robert E. Klinkowstein, Winchester; Ruth Shefer, Newton, all of Mass.

[73] Assignee: Science Research Laboratory, Inc., Somerville, Mass.

[21] Appl. No.: 695,313

[22] Filed: May 3, 1991

[51] Int. Cl.[5] ..... G21G 1/00

[52] U.S. Cl. ..... 376/156; 376/194; 376/195; 376/202

[58] Field of Search ..... 376/194, 195, 198, 201, 376/202, 156; 250/492.1, 492.3

[56] References Cited

U.S. PATENT DOCUMENTS

| | | | |
|---|---|---|---|
| 2,251,190 | 7/1941 | Kallman | 250/84 |
| 3,311,769 | 3/1967 | Schmidtlein | 313/32 |
| 3,860,827 | 1/1975 | Cranberg | 250/499 |

*Primary Examiner*—Donald P. Walsh
*Assistant Examiner*—Frederick H. Voss
*Attorney, Agent, or Firm*—Wolf, Greenfield & Sacks

[57] ABSTRACT

This invention relates to a method and apparatus for the generation of isotopes, and in particular radioisotopes, from a target material which is not normally a solid and which, when bombarded by selected high energy particles, produces the selected isotope. A surface is provided which is preferably of a thermally-conductive material, which surface is cooled to a temperature below the freezing temperature of the target material. A thin layer of target material is then frozen on the surface and the target material is bombarded with the high energy particles. The beam of high energy particles is preferably at an angle to the surface such that the particles pass through a thickness of the target material greater than the thickness of the layer before reaching the surface. When the desired quantity of isotope has been produced from the target material, the target material, which has now been altered nuclearly to contain the selected isotope, is removed from the surface. The target material may be melted or sublimated to facilitate extraction or extraction may be accomplished in some other way. For the preferred embodiment, the target surface is the interior surface of a cone.

35 Claims, 2 Drawing Sheets

METHOD AND APPARATUS FOR GENERATING ISOTOPES

FIELD OF THE INVENTION

This invention relates to isotope generators and more particularly to a method and apparatus for generating radioisotopes from a frozen target material by bombarding the frozen target with high energy particles.

BACKGROUND OF THE INVENTION

A number of radioisotopes are currently being utilized as markers and for other purposes in various medical, scientific, industrial and other applications. Since such radioisotopes frequently have a relatively short half-life, from a few hours on down to a few minutes, it is generally desirable that such radioisotopes be either produced at the site where they are going to be utilized, or at a site relatively close thereto.

However, the equipment for generating radioisotopes is currently relatively large and expensive, normally involving the use of a cyclotron, and the equipment for some radioisotopes, including $^{18}F$, also suffer from a lack of uniform results and an inability to achieve high yields. The lack of high yields, coupled with the short half life of the radioisotopes, limits the procedures in which such radioisotopes can be used to procedures requiring small radioisotope quantities, and also limits the number of procedures which can be performed. The cost and bulk of the equipment also makes it impractical to have such equipment at anything other than major hospital centers or research facilities, and thus limits the locations where procedures such as positron emission tomography (PET), or other procedures requiring such radioisotopes, can be performed to such facilities or ones situated in close proximity thereto. However, the usefulness of procedures utilizing radioisotopes in medical diagnosis and other applications render the wider availability of such radioisotopes desirable. In particular, Fluorine-18 ($^{18}F$), primarily because of its relatively long half-life (110 minutes), has emerged as the most widely used radioisotope in PET procedures, and a need exists for a procedure to permit on site generation of the radioisotope.

Current radioisotope generators normally operate by bombarding a selected target material with a high energy particle beam from a cyclotron or other particle accelerator. This results in a nuclear reaction leaving the desired radioisotope at the target.

One of the reasons for the relatively low yield obtained with such radioisotope generators for radioisotopes such as $^{18}F$ which are generated from a water based target is that there is a lack of proportionality between increases in the current of the high energy beam and the radioisotope yield. This lack of proportionality is particularly true for high beam currents (i.e. currents in excess in 15 microamps). This loss of yield stems from a number of sources, including bubbles formed from vapor produced in the target by local boiling, and radiolysis which reduces the effective thickness of the target layer. Radiolysis is the breaking of the chemical bonds of the target substance. For example, with a water target, various forms of water often being used as targets, radiolysis would result in the water breaking into hydrogen and oxygen gas which would be dissipated. Thus, radiolysis can result in a reduction in the effective thickness of the target layer which in extreme cases can result in a substantial percentage of the target material being lost.

Since factors such as vapor production and radiolysis appear not to occur uniformly for a given beam current, yields of certain radioisotopes may vary substantially from batch to batch. In some situations, a substantial percentage, approaching 30%, of batches produce as little as 50% of the average yield. Since the time required to generate a batch of radioisotopes may be as long or longer than the half life of the radioisotope, unreliability in yield is a substantial limitation in utilizing such radioisotopes in a clinical setting since the yield from a given batch may not be adequate to meet a scheduled patient need. The inability to increase yield by increasing currents for the reasons indicated above also limits the usefulness of such procedures because of limited isotope availability. Still another problem with existing technology is the high cost of target materials such as enriched $^{18}O$ water (i.e., $100/ml). Targets have, therefore, been designed with small volumes to reduce the cost of producing the radioisotopes. This has also held down the yields available, and means that the loss of target material due to vapor, radiolysis and the like discussed above can substantially add to radioisotope production costs.

Radiolysis also results in an increase in pressure at the target. Since the high energy beam must be generated in a vacuum, if vacuum cannot be maintained at the target, then a window transparent to the high energy particles must be provided between the high energy particle source and the chamber containing the target. Such windows, which are generally in the form of a thin foil, absorb energy from the beam passing therethrough and, particularly for high energy beams, must be cooled in order to avoid their burning out. The pressure differential across such windows, with vacuum on one side and target pressure on the other, which pressure differential can at times be substantial, particularly for fluid or gaseous targets (fluid or gaseous being sometimes collectively referred to hereinafter as "liquid") also results in stresses on the window which lead to window failure. Therefore, the existence of such windows in a radioisotope generating system presents a severe maintenance problem which reduces the time which the equipment can be used for generating radioisotopes, and thus reduces the yield of radioisotope available from a given machine. The overhead required for cooling the window also adds to the complexity in the design and use of the equipment. The ability to either eliminate the need for a window, or as a minimum to reduce the stresses on the window is, therefore, another important factor in reducing cost for generating radioisotopes and in increasing the yield available from a given radioisotope generating device.

While the problems discussed above are more common for radioisotopes, some of the problems, such as those caused by the need for a window to isolate target pressure, may also be present where stable isotopes, such as $^{15}N$ or $^{5}Li$, are being generated.

It is, therefore, desirable to provide an improved method and apparatus for generating isotopes in general, and radioisotopes in particular, which can be smaller and less expensive than prior art generators so as to be usable at a greater number of facilities. It is also desirable to reduce the losses of target material due to radiolysis and the like and to thus increase the yields available from a given quantity of target material. The improved method and apparatus should also permit vacuum or near vacuum pressure to be maintained in the chamber containing the target so that windowless operation may be achieved, or as a minimum, that pressure differentials across the window be minimized. The above would permit higher yields of radioisotopes to be obtained at lower cost.

SUMMARY OF THE INVENTION

In accordance with the above, this invention provides a cryogenic target for use in the generation of isotopes and an improved method and apparatus for the generation of isotopes by use of such a cryogenic target.

More particularly, this invention provides a method and apparatus for producing a selected radioisotope (or other isotope) from a target material which is not normally a solid and which, when bombarded by selected high energy particles, produces the selected radioisotope. A surface is provided of a thermally and electrically conductive material such as copper which is cooled to a temperature below the freezing temperature of the target material. A thin layer of target material is then frozen on the surface and the target material is bombarded with high energy particles. The high energy beam is preferably at an angle to the surface such that the particles pass through a thickness of the target material greater than the thickness of the layer before reaching the surface. The bombarding continues for a selected time period great enough to permit production of a desired quantity of the radioisotope from the target material. When the bombardment is completed, the target material, which now has been altered nuclearly to contain the selected radioisotope, is removed from the surface. For the preferred embodiment, this is accomplished by melting and then extracting the radioisotope-containing target material.

To form or deposit the thin layer of target material on the surface, a quantity of the target material is introduced in vapor form into the environment containing the target, preferably by directing the target material as a jet spray from a nozzle at the surface. The nozzle is preferably retractible when not in use.

For the preferred embodiment, the surface on which the target material is deposited is the interior surface of a cone, the interior surface extending at an angle $\theta/2$ to the central axis of the cone. The bombarding beam of high energy particles is preferably directed at the interior surface of the cone in the direction of the cone's central axis, and thus at an angle $\theta/2$ to the surface of the target material.

When the surface is a cone, the cone is preferably tilted so that its axis is oriented substantially vertical before the target material is melted. This permits the melted radioisotope containing target material to collect at the bottom or tip of the cone, with suitable means being provided for forcing the collected material from the cone tip. The surface is preferably located in an evacuated environment.

Since energy from the high energy particles is dissipated in the cone, a means is provided for facilitating the cooling of the cone to dissipate such heat. For a preferred embodiment, this is accomplished by providing at least one fin extending from an exterior surface of the cone. For the preferred embodiment, there are a plurality of such fins which are integral and preferably coaxial with the cone.

For the layer of frozen target material on the interior surface of the cone, there is a minimum depth $t_b$ that the high energy particles must pass through such layer to fully produce the radioisotope therefrom. For the preferred embodiment, the cone angle $\theta$ and the thickness $t_i$ of the target material layer are selected such that:

$$t_i = t_b \sin \theta/2$$

The foregoing and other objects, features and advantages of the invention will be apparent from the following more particular description of a preferred embodiment of the invention as illustrated in the accompanying drawings:

IN THE DRAWINGS

DETAILED DESCRIPTION

Figure 1:
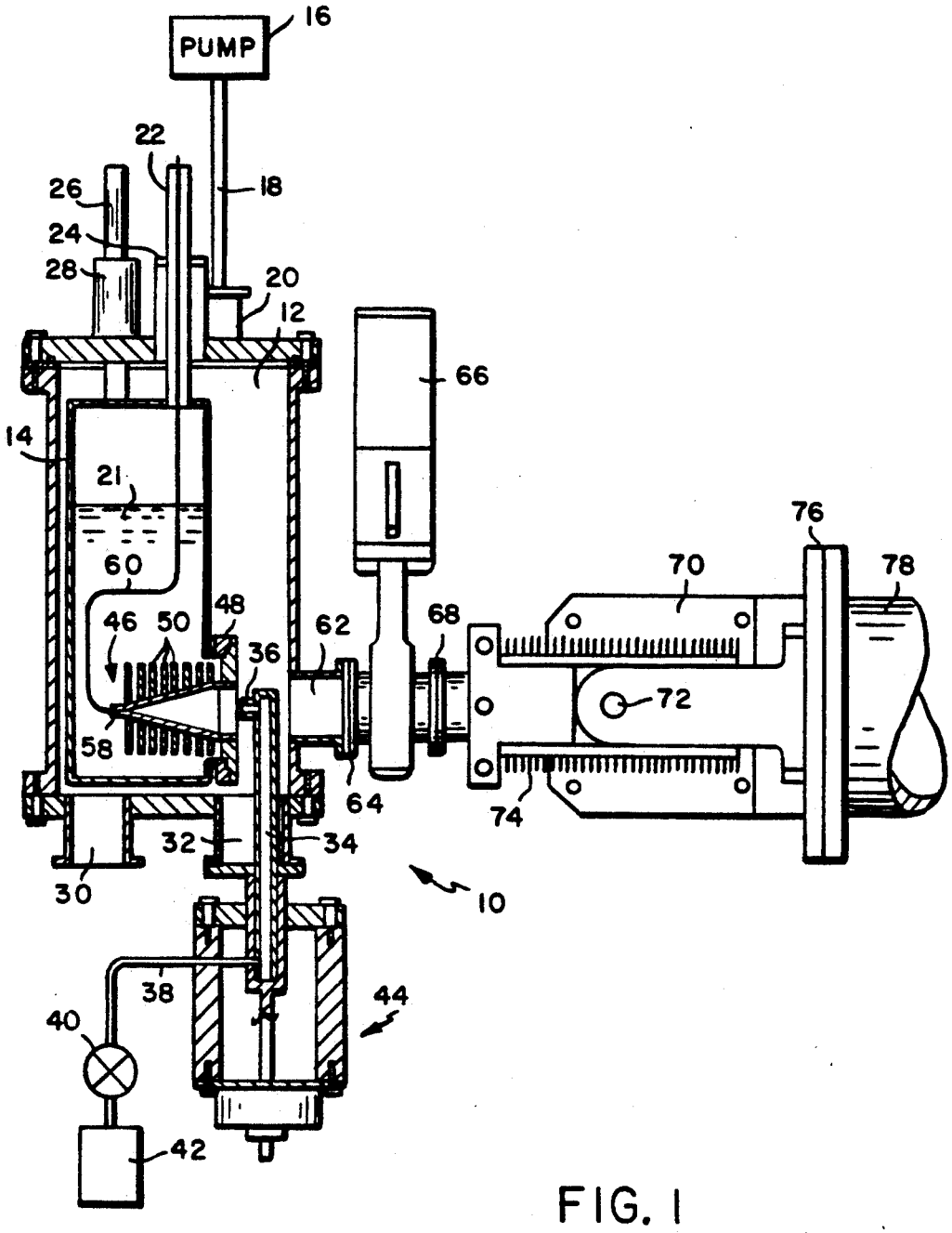
FIG. 1 is a partially cut away side view of a radioisotope generating apparatus employing the teachings of this invention.

Referring first to FIG. 1, a radioisotope generating apparatus or system which may be utilized in practicing the teachings of this invention is shown. The apparatus 10 consists of a sealed chamber 12 having a cryogenic dewer 14 positioned therein. A desired pressure, for example, vacuum pressure, may be maintained in chamber 12 by a suitable vacuum source, for example, a pump 16, connected to the chamber through tube 18 and sealed port 20 leading into the chamber. Alternatively, vacuum pressure may be obtained from the accelerator in a manner to be described later. Liquid nitrogen 21 or another suitable cooling agent such as liquid helium or liquid oxygen is applied to dewar 14 from a suitable source through tube 22 which tube passes through a port 24 in chamber 12. The cooling agent (coolant) may be removed from dewar 14 through a tube 26 attached to the dewar, which tube passes through a sealed port 28 in chamber 12.

Chamber 12 also has a port 30 which is a spare port which may be used for taking measurements or other suitable purposes, and a port 32 having a tube 34 passing therethrough. The end of tube 34 in chamber 12 has a vapor jet nozzle 36 which is pointed in a generally horizontal direction. The end of tube 34 outside of chamber 12 is connected through a tube 38 and valve 40 to a target material reservoir 42. Tube 34 is mounted in a nozzle retraction assembly 44 which raises the nozzle to the position shown in FIG. 1 when the nozzle is to be utilized and otherwise retracts the nozzle to a position near the bottom of chamber 12 or in port 32.

A funnel-shaped or cone-shaped target 46 is mounted in the lower portion of cryogenic dewar 14 with the axis of the cone oriented horizontally. The wide end of the cone is positioned opposite nozzle 36 and is sealed by a sealing ring 48 in the dewar. A plurality of cooling rings 50 are formed around the outer periphery of cone 46. The cone 46 and rings 50 are formed of a material having good heat transfer, and preferably also good electrical conduction, properties, for example a metal such as copper. The cone and rings may be integrally formed or may be separate elements which are pressure-fit, soldered or otherwise secured together. For a preferred embodiment, the cone is initially formed with a thick wall, and grooves are then machined into the walls to form the fins 50, which fins are thus integral with and concentric with the cone.

Figure 2:
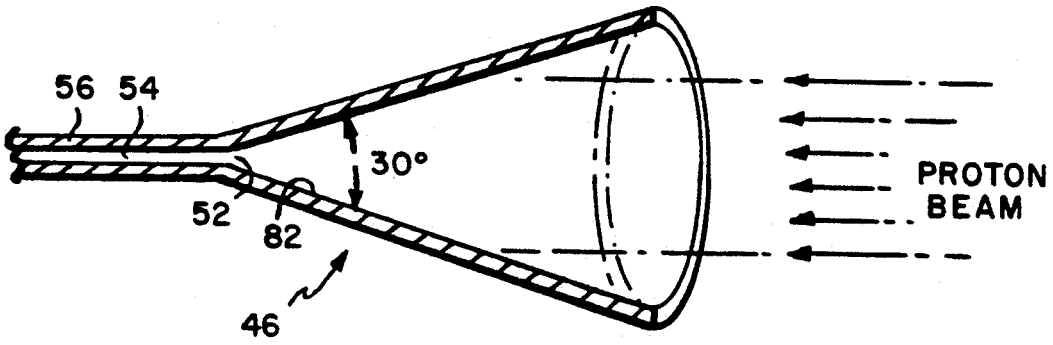
FIG. 2 is an enlarged cutaway side view of a cone or funnel shaped target suitable for use in the system of FIG. 1.

As may be best seen in FIG. 2, there is a small opening 52 at the tip of cone 46 which leads into a channel 54 in a tube 56 extending from the cone tip. Tube 54 is connected by a fitting 58 (FIG. 1) to an extraction tube 60 which passes out of dewar 14 and chamber 12 through tube 22. Extraction tube 60 would be connected to a suitable collection vessel (not shown).

The final port on chamber 12, port 62, is connected through a sealed joint 64 to a fast solenoid gate valve 66. Gate valve 66 can be used to seal port 62 under circumstances to be described later, but is normally open.

The gate valve is connected through a sealed joint 68 to a rotating bellows assembly 70. Assembly 70 has a pivot 72 about which the entire assembly to the left thereof in FIG. 1 may rotate from the generally horizontal position shown in FIG. 1 to a vertical position 90° counterclockwise from the position shown. The flexible metal bellows 74 flexes as the assembly is rotated to maintain an airtight seal during rotation.

Assembly 70 is connected at an airtight sealed joint 76 with a high energy particle accelerator 78. The high energy particle accelerator may be, for example, a cyclotron particle accelerator, which provides higher yields, or a tandem cascade accelerator such as that shown in U.S. Pat. No. 4,812,775, issued Mar. 14, 1989. The tandem cascade accelerator, which is smaller and less expensive, utilizes a lower energy beam at higher current than accelerators such as a cyclotron. Other lower energy, high current accelerators which might be utilized as the accelerator 78 are shown in copending application Ser. No. 07/488,300, filed Mar. 2, 1990. Accelerator 78 may, depending on the isotope desired, be generating accelerated protons, deuterons, electrons, or other particles. For a preferred embodiment of the invention where the apparatus is being utilized to produce fluorine-18 ($^{18}F$), a tandem cascade accelerator is utilized to produce an up to 1 mA beam of 3.7 MeV protons which impinge on a target of enriched $^{18}O$-ice.

One problem with prior art devices for generating radioisotopes is that when the high energy beam impinged on the target, which target was generally in liquid or gaseous form, the heat of the reaction would cause vaporization of the target substance. Further, the impingement of the high energy beam on the target material could also cause radiolysis as previously described, resulting in the release of gases such as hydrogen and oxygen. These released gases create a vapor pressure which varies with the target substance and beam energy, which vapor pressure, in conjunction with the normal target pressure of a liquid, degrades the vacuum required in accelerator 78. Therefore, it has been necessary to provide a window in junction 76, generally a thin metal foil, to separate the target chamber 12 from the accelerator 78. However, such windows, particularly for low energy, high current accelerators, tend to get hot as they absorb a small portion of the beam energy passing therethrough, and extensive cooling overhead may be required to prevent such windows from burning out. Further, if the total target pressure becomes substantial, the pressure differential across the window causes stresses in the window which may ultimately result in window failure. Window failure from pressure, heat or a combination thereof is, therefore, a significant maintenance problem in prior art radioisotope generators.

It is, therefore, desirable to eliminate the need for such a window by reducing or eliminating the vapor pressure resulting from radioisotope generation so that either a window is not required, or the pressure gradients across the window are sufficiently small that window damaging stresses do not develop.

Where a window is not employed in junction 76 and gate valve 66 is open, vacuum pressure in accelerator 78 is applied directly to chamber 12 so that pump 16 need only be used to pressurize the chamber, not to evacuate it.

In accordance with the teachings of this invention, the objective of reducing pressure gradient across the junction 76, and thus permitting the window to be eliminated, is generally accomplished by employing a solid target, and in particular a frozen or cryogenic target, which is designed so as to minimize vaporization at the target surface. Since radiolysis is known to be substantially reduced in solids due, for example, to the lower mobility of free radicals, such a target also reduces the material losses due to radiolysis, and thus increases radioisotope yield for a given quantity of target substance and also reduces the vapor pressure causing release of the radiolysis gases. In particular, the parameter G, defined as the number of molecules radiolysed per 100 eV of incident particle energy, is roughly a factor of 10 lower for ice at 77° K. than for room temperature water. This decrease in G with temperature may be due to trapping and subsequent recombination of radiolysis products in the solid lattice which reduces the number of chain reactions involved in radiolysis compared to a liquid target. In addition, the fraction of molecular products which actually escape the solid lattice should decrease with lowered temperature, thus further lowering the value of G.

In particular, with the assembly oriented as shown in FIG. 1, pump 16, or preferably accelerator 78, applies vacuum to chamber 12 to evacuate this chamber. Liquid nitrogen 21 or other coolant is also applied through tube 22 to cryogenic dewar 14, reducing the temperature in the dewar to approximately 77° K. The temperature of target cone 46 is also reduced to approximately 77° K.

Nozzle 36 is then raised by assembly 44 to the position shown in FIG. 1 directly adjacent cone 46 and valve 44 is opened for a selected time period. Since nozzle 36 is at vacuum pressure while reservoir 42 is at the vapor pressure of water, when valve 40 is opened, vapor will be drawn from reservoir 42 at a known rate through tube 38 and tube 34 to nozzle 36. Thus, by controlling the duration that valve 40 is open, a precisely controlled quantity of target material is permitted to pass to nozzle 36. The velocity of the fluid traveling through tube 34 and the construction of nozzle 36 causes a vapor jet of the target material to be directed toward cone 46. This vapor freezes on cone 46 to form a thin layer 80 (FIG. 3) of the target material on the interior surface 82 of cone 46. With the cone 46 maintained at 77° K., the sticking fraction of the target material from nozzle 36 on cone 46 is greater than 90%.

The vapor jet is a directional technique for depositing the target material in a specific location, the nozzle being designed generally to confine the target material to a selected expansion angle, for example 60°. By varying the distance between the nozzle and cone 46, the coverage of frozen target material on the cone can be varied. Since the water vapor density is larger in the center of the jet than at the edges, depositing on the inverted cone may aid in creating a more uniform coating.

While the desired coating on cone 46 may be achieved by merely introducing target material into chamber 12, this will result in a significantly lower percentage of the target material inputted into the chamber being deposited and frozen on the inside of cone 46. The additional target material in chamber 12 must ultimately be removed and is, therefore, undesirable. Further, the cost of the target material, for example $100/ml for $^{18}O$-water, makes it economically desirable that such target material not be wasted.

While forming the target as a cryogenic ice layer has advantages as indicated above in providing both increased yield due to reduced radiolysis and reduced vapor pressure, the deposition of such a cryogenic target material on a cone shaped target provides additional advantages. First, in order to adequately cool the target ice layer 80, it is important that the ion beam be spread over as large an area as possible, preferably greater than 10 $cm^2$. This could be done by expanding the ion beam from generator 78 using a magnetic lens. However, at the beam energy required for efficient production of radioisotopes such as $^{18}F$, the required magnetic lens is inconveniently bulky. A simpler method of spreading the beam over a large area is to have the target mounted at an oblique angle to the ion beam. This may be accomplished with an inclined plane, but is preferably accomplished with the cone-shaped target 46 oriented as shown in FIG. 1.

Figure 3:
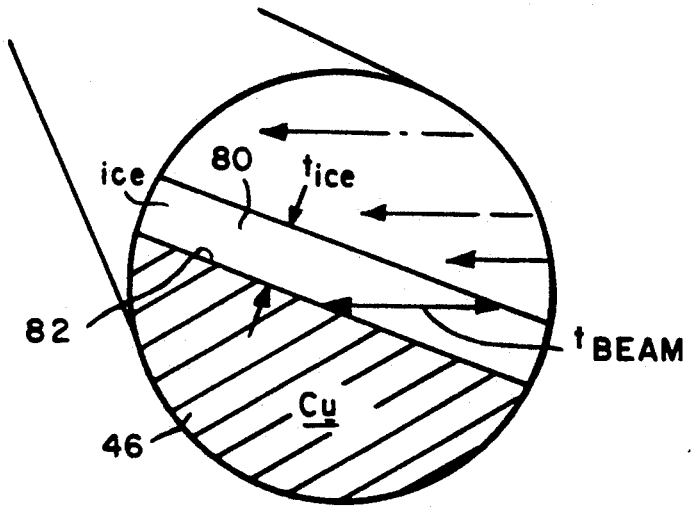
FIG. 3 is an enlarged view of the circled portion of FIG. 2.

The cone geometry has an additional advantage as illustrated in FIG. 3 in that the beam path through the frozen target layer 80 is larger than the perpendicular distance from the surface of the ice to the cooled surface 82 of cone 46 (i.e. $t_b > t_i$). Since the temperature of the ice increases with distance from surface 82, and since there is a minimum beam path length $t_{b'}$ which the beam must pass through the target material in order for a desired quantity or yield of radioisotope to be obtained from the target, the geometry shown in FIG. 3 allows the surface of the ice layer to be maintained at a lower temperature than would be possible with a flat target mounted perpendicular to the ion beam while still obtaining the desired yield. The lower surface temperature of ice layer 80 reduces the amount of evaporation from the surface and thus reduces vapor pressure and enhances yield. This geometry also reduces the amount of target material required to load the target, a thin layer of target material being usable, and thus reduces the cost for radioisotope production. To determine the thickness $t_i$ for ice layer 80 in order to obtain a beam length $t_{b'}$ for a given target material which is suitable for the formation of the desired quantity of radioisotope for a cone having a given cone angle $\theta$, the following equation applies:

$$t_i = t_{b'} \sin \theta/2 \quad (1)$$

This equation may need to be modified by a factor d which is the density of the ice or other frozen target material in $gm/cm^3$ such that Equation 1 becomes:

$$t_i = t' \frac{\sin\theta/2}{d} \quad (2)$$

Where t' is the required target thickness in $gm/cm^2$.

For a preferred embodiment where $^{18}F$ is being generated from $^{18}O$ ice using a 3.7 MeV proton beam, $t_{b'}$ is approximately 136 micrometers. For this configuration, and a cone angle $\theta$ of 30°, the thickness of layer 80 is approximately 35 micrometers, for a total volume of target material of approximately 0.042 $cm^3$. However, a thinner layer of $^{18}O$ ice may be utilized where optimum $^{18}F$ yield is not required to reduce heating of the ice.

When depositing of frozen target layer 80 is complete, gate valve 66 is opened, if it is not already opened to create the vacuum. Assembly 44 is also operated to retract nozzle 36 to a position at the bottom of chamber 12 or in port 32. Accelerator 78 is then operated to apply a proton or other suitable particle beam of suitable energy and current to target layer 80. The duration of target radiation will vary with the radioisotope desired and the reaction utilized to obtain it, but is normally related to the half life of the radioisotope. Thus, for example, for the $^{18}F$ reaction previously discussed, the radiation time is approximately 110 minutes which is equal to the half life of $^{18}F$.

Many of the radioisotope creating reactions have a threshhold energy. Thus, in order for the $^{18}F$ reaction previously discussed to occur, a minimum energy of 2.5 MeV is required. Thus, if a 3.7 MeV proton beam is utilized, only 1.2 MeV of the beam energy need be deposited in ice layer 80, since anything beyond this will not result in $^{18}F$ formation. This will yield 2.7 Ci/mA. The remaining 2.5 MeV of the protein beam energy is dissipated in cone 46. In order to avoid overheating of the ice, less than the 1.3 MeV may actually be deposited in the ice in practical applications so long as desired quantities of radioisotopes can be obtained with such lesser energy.

Therefore, since a substantial amount of beam energy is dissipated in the cone, including both the energy initially deposited in the ice and that deposited in the cone, and in order to maintain cone 46 at a preferred temperature of approximately 77° K., the coolant 21 in dewar 14 must be able to remove this quantity of heat from the cone. However, coolants have a burn out heat flux. Thus, if liquid nitrogen is used to remove more than approximately 10 $W/cm^2$, a burn-out of heat flux occurs so that the liquid nitrogen loses its ability to cool and temperature rises quickly. This is because vapor film boiling at this point surrounds the entire object, and thus heat cannot be removed by convection. Sufficient heat must be dissipated across the barrier radiatively, resulting in the temperature rise.

In order to avoid this burn out heat flux effect, fins 50 are provided on cone 46 to increase its surface area. While the total external surface in contact with the coolant for the cone alone is only 12 $cm^2$, the fin assembly may be dimensioned to increase the total surface area to approximately 360 $cm^2$ for a preferred embodiment, providing more than adequate surface area to avoid flux burn out. Some proton beam energy will also be dissipated in the ice layer 80. However, since the ice layer is very thin, this energy should not raise the temperature of the ice layer more than a few degrees and should result in minimum vaporization.

When radiation of the target is complete, the desired yield of the radioisotope having been obtained, accelerator 78 is turned off and solenoid gate 66 is preferably closed to isolate the accelerator from chamber 12. The entire assembly 10 to the right of pivot point 72 is then rotated about pivot point 72 in a counterclockwise direction 90° so that the axis of cone 46 is vertical with the tip of the cone pointing downward. The apparatus may be moved to this position manually with a suitable latch and release being provided in each detent position to assure proper orientations, or a suitable manually or automatically controlled mechanism may be provided for effecting such movement.

With the apparatus oriented in the vertical position described above, coolant is pumped out of dewar 14 through tube 26, permitting the temperature in the dewar, and thus the temperature of cone 46, to rise rapidly to room temperature. This causes the frozen target material, which has been altered to contain the desired radioisotope, to melt and to flow down the sides of cone 46 to accumulate as a droplet at the tip of the cone. To the extent surface tension or the like may prevent all of the melted target material from flowing under the effect of gravity to the tip of the cone, a mechanism may be provided to, for example, vibrate the cone, or preferably the entire assembly, to break such surface tension bonds and to facilitate the flow of all of the target material to the tip.

The vacuum in chamber 12 is preferably removed before the melting operation, for example, by the closing of gate valve 66. When the droplet of target material is formed in the tip of cone 46, a slight positive pressure is applied by pump 16 to chamber 12 to force the droplet out through opening 52 and channel 54 into extraction tube 60 and out through the extraction tube to the collection vessel (not shown).

The apparatus may then be returned to the orientation shown in FIG. 1, again either manually or by use of a suitable motor or other mechanism, and the sequence of operations described above repeated to produce a new batch of radioactive material. If the material to be produced for a second batch is different than the material produced during the first batch, then it may be necessary to either replace cone 46 or to take other suitable steps to avoid potential contamination.

While in the discussion above it has been assumed that there is no window at the junction 76, and this would be true for the $^{18}F$ reaction discussed above which results in very low vapor pressure which can be dissipated by the vacuum, where the target material and reaction to generate a particular isotope results in a higher vapor pressure, a window may be required at juncture 76 to avoid contaminating the vacuum in accelerator 78. However, where a solid target is utilized, it is possible to maintain a vacuum or near vacuum in chamber 12 and thus to minimize the pressure differential across the window. Therefore, while the problem of dissipating heat from the window still exists with a solid target, the stresses on the window resulting from high pressure differentials thereacross are substantially eliminated, resulting in far less problems with window damage and thus far less maintenance overhead.

While the discussion above has been primarily with reference to the generating of $^{18}F$ radioisotopes, it is apparent that the teachings of this invention could be utilized to generate many other commonly used radioisotopes, including carbon-11, nitrogen-13 and oxygen-15. For example, oxygen 15 could be generated with a frozen nitrogen-14 target bombarded with deuterons, nitrogen-11 with a frozen carbon target such as frozen $CO_2$, etc. The teachings of this invention might also be utilized, if desired, to generate certain stable isotopes such as $^{15}N$ or $^{5}Li$.

Further, while a cone has been shown as the target surface for a preferred embodiment, it is apparent that other angled surfaces, for example an angled flat surface, could be utilized. However, the cone shape is clearly advantageous in that it provides optimum surface area and also facilitates the collection of the melted radioisotope-containing target material. Also, while having an angled surface is advantageous in permitting the use of a thinner ice layer to achieve a given yield, an angled target surface is not an essential limitation on the invention and some of the advantage of having a cryogenic target for isoptope generation can be achieved with targets shaped and positioned such that all or a substantial part of the target are at angle perpendicular to the high energy particle beam.

In addition, while melting the isotope containing ice target and extracting the resultant droplet is the preferred method of isotope extraction, other techniques might also be utilized to extract the isotope. For example, target 46 could be heated under conditions to cause sublimation of the ice, the ice evaporating or vaporizing to a gas which then may be removed from the chamber, for example through extra port 30. Where the isotope is to be mixed or dissolved in some other substance, it may also be possible to simply remove the cone with the ice layer adhering thereto and dipping the frozen cone in the higher temperature liquid or gas in which the isotope is to be utilized, the ice melting and simultaneously going into solution. The two techniques discussed above would be particularly advantageous where a target surface other than a cone was being utilized.

Such techniques might also permit a simplification of the equipment shown in FIG. 1 in that rotating bellows assembly 70 would not be required, nor would rotation of the portion of the device to the right of pivot point 72 be requred during the extraction process. It may also be possible to eliminate the rotation step by initially orienting the cone vertically, and either also mounting the accelerator to be vertical or preferably bending the particle beam to properly impinge on the target.

While several methods of extraction have been discussed above, it is apparent that such techniques are only illustrative of techniques available for extracting the ice target material from the target surface after the desired radioisotope or other isotope has been formed therein, and it is the intent that such other extraction techniques also be included within this invention. Other changes in the details of construction are also possible.

Thus, while the invention has been particularly shown and described above with reference to a preferred embodiment, the foregoing and other changes in form and detail may be made therein by one skilled in the art while still remaining within the spirit and scope of the invention.

What is claimed is:

1. A method for producing a selected isotope from a target material which is not normally a solid and which, when bombarded by selected high energy particles, produces the selected isotope, comprising the steps of:

forming a frozen layer of the target material on a cooled target surface;

bombarding the target material with said high energy particles for a selected time period, the target material being altered by the bombarding particles to contain a quantity of the isotope; and extracting the isotope-containing target material.

2. A method as claimed in claim 1 wherein said forming step includes the steps of cooling the surface to a temperature below the freezing temperature of the target material, and introducing the target material into the vicinity of said surface in a liquid form.

3. A method as claimed in claim 2, wherein the introducing step includes the step of directing the target material as a jet spray at the surface.

4. A method as claimed in claim 1 wherein said surface is the interior surface of a cone having a central axis, said interior surface extending at an angle $\theta/2$ to said axis; and wherein said bombarding step includes the step of directing a beam of said high energy particle at said interior surface in the direction of said axis, and thus at an angle $\theta/2$ to the surface.

5. A method as claimed in claim 4 wherein said extracting step includes the steps of melting the isotope-containing target material, and extracting the melted material.

6. A method as claimed in claim 5 including the step, performed prior to the melting step, of tilting the cone so that is axis is oriented substantially vertical.

7. A method as claimed in claim 5 wherein said extracting step includes the steps of collecting the melted, isotope-containing target material at the tip of the cone, and forcing the collected material from the cone tip.

8. A method as claimed in claim 1 wherein said selected time period is the time required to obtain a desired quantity of the selected isotope for the particle energy and target material layer thickness utilized.

9. A method as claimed in claim 1 including the step of evacuating the environment in which the surface is located.

10. A method as claimed in claim 1 wherein said extracting step includes the steps of heating the isotope-containing target material to sublimate the material, and extracting the sublimated material.

11. A method as claimed in claim 1 wherein said high energy particles are at an angle to said surface such that the particles pass through a thickness of the target material greater than the thickness of said layer before reaching said surface.

12. A method as claimed in claim 1 wherein said selected isotope is a radioisotope.

13. A method as claimed in claim 12 wherein said radioisotope is $^{18}F$ and wherein said frozen target material is $^{18}0$ ice.

14. Apparatus for producing a selected radioisotope from a target material which is not normally a solid and which, when bombarded with selected high energy particles, produces the selected isotope, the apparatus comprising:

a target surface;

means for cooling the surface to a temperature below the freezing temperature of the target material;

means for depositing a layer of frozen target material on the surface;

means for bombarding the target material with said high energy particles for a selected time period, the target material being altered by the bombardment to contain a quantity of the selected isotope, and;

means for extracting the isotope-containing target material.

15. Apparatus as claimed in claim 14, including a sealed chamber in which said surface is positioned; and wherein said means for depositing includes means for introducing the target material into the chamber in liquid form.

16. Apparatus as claimed in claim 15 wherein said means for introducing includes a nozzle in said chamber for directing the target material as a jet spray at the surface.

17. Apparatus as claimed in claim 16 wherein said nozzle is adjacent to said surface when it is directing target material thereat, and including means for retracting said nozzle when not in use.

18. Apparatus as claimed in claim 14 wherein said surface is the interior surface of a cone having a central axis, said interior surface extending at an angle $\theta/2$ to said axis.

19. Apparatus as claimed in claim 18, including a sealed chamber, and means for mounting said cone in the chamber with its axis pointed in the direction of the means for bombarding.

20. Apparatus as claimed in claim 19 wherein said means for extracting includes means for melting the isotope-containing target material, and means for extracting the melted material.

21. Apparatus as claimed in claim 20, including means operative prior to said means for melting for tilting the cone so that is axis is oriented substantially vertical.

22. Apparatus as claimed in claim 21 wherein said melted, isotope-containing target material flows from said surface to the tip of the cone, and wherein said means for extracting includes means for forcing the collected target material from the cone tip.

23. Apparatus as claimed in claim 22 wherein said means for forcing includes means for applying positive pressure to the target material in the tip.

24. Apparatus as claimed in claim 22 including means for facilitating the flow of melted target material to said tip.

25. Apparatus as claimed in claim 21 wherein said means for tipping includes means for pivoting the chamber.

26. Apparatus as claimed in claim 18, including means for facilitating the cooling of the cone to dissipate heat resulting from the high energy particles applied thereto by said means for bombarding.

27. Apparatus as claimed in claim 26 wherein said means for facilitating cooling includes at least one fin extending from an exterior surface of said cone.

28. Apparatus as claimed in claim 27 wherein said fins are integral with the cone.

29. Apparatus as claimed in claim 14 wherein said target surface is part of a target structure, and wherein said means for cooling includes means for placing at least a portion of the target structure in contact with a liquid coolant.

30. Apparatus as claimed in claim 29 wherein said liquid coolant is liquid nitrogen.

31. Apparatus as claimed in claim 14 wherein there is a minimum depth $t_{b'}$ that the high energy particles must pass through the deposited frozen target material layer to produce a desired quantity of isotope from the target material, and wherein the cone angle $\theta$ and the layer thickness $t_i$ are selected such that $t_i \sim t_{b'}$ sine $\theta/2$.

32. Apparatus as claimed in claim 14 wherein the extracting means includes means for heating the isotope-containing target material to sublimate the material, and means for extracting the sublimated material.

33. Apparatus as claimed in claim 14 wherein said high energy particles are at an angle to said surface such that the particles pass through a thickness of the target material greater than the thickness of said layer before reaching said surface.

34. Apparatus as claimed in claim 14 wherein said selected isotope is a radioisotope.

35. Apparatus as claimed in claim 34 wherein said selected radioisotope is $^{18}F$, and wherein said frozen target is $^{18}0$-ice.

* * * * *